US006098196A

United States Patent [19]

Logan

[11] Patent Number: 6,098,196

[45] Date of Patent: Aug. 8, 2000

[54] BODY ARMOR

[76] Inventor: Michael Logan, 3225 John Conley Dr., Lapeer, Mich. 48446

[21] Appl. No.: 09/159,975

[22] Filed: Sep. 24, 1998

Related U.S. Application Data

[60] Provisional application No. 60/060,379, Sep. 29, 1997.

[51] Int. Cl.[7] ..... A41D 13/00; F41H 5/08

[52] U.S. Cl. ..... 2/2.5; 2/9; 2/463; 89/36.05

[58] Field of Search ..... 2/455, 462, 463, 2/6.4, 6.5, 427, 2.5, 102, 92, 247, 94, 468, 15, 11, 9, 203, 206, 208; 89/36.05, 36.07; 109/49.5

[56] References Cited

U.S. PATENT DOCUMENTS

| | | | |
|---|---|---|---|
| 1,277,706 | 9/1918 | Dorfman | 2/2.5 |
| 1,298,618 | 3/1919 | Wloszek | 2/2.5 |
| 3,302,214 | 2/1967 | Yuritch | 2/2.5 |
| 3,707,004 | 12/1972 | Kapitan et al. | 2/2.5 |
| 4,535,478 | 8/1985 | Zufle | 2/2.5 |
| 4,680,812 | 7/1987 | Weigi | 2/2.5 |
| 4,774,724 | 10/1988 | Sacks | 2/2.5 |
| 5,392,686 | 2/1995 | Sankar | 89/36.05 |
| 5,431,318 | 7/1995 | Garcia | 2/2.5 |

FOREIGN PATENT DOCUMENTS

| | | | |
|---|---|---|---|
| 2442881 | 3/1976 | Germany | 2/2.5 |

*Primary Examiner*—John J. Calvert
*Assistant Examiner*—Tejash Patel
*Attorney, Agent, or Firm*—Young & Basile, P.C.

[57] ABSTRACT

An extendable neck/face protecting ballistic shield attached to a ballistic vest for rapid deployment between storage and neck/face protecting positions.

14 Claims, 2 Drawing Sheets

44c
44e
44b
44
44d
44a
22

54
54b
10
56c
56b
56d
22
54a
56a
16

BODY ARMOR

This application claims the benefit of the prior filed co-pending U.S. provisional Application No. 60/060,379 filed Sep. 29, 1997.

FIELD OF THE INVENTION

The present invention is in the field of body armor.

BACKGROUND OF THE INVENTION

In recent years soft body armor has become almost universally standard equipment for police agencies and military personnel. Depending on the anticipated threat, the armor comes in different configurations and levels of protection.

Body armor configurations vary from the minimalist police designs, which are designed to be concealed under fairly standard clothing, with just enough protection to protect the vital organs; to military and bomb disposal armor which is much bulkier, designed to be worn over clothing, and usually provides much greater coverage of the body, often including full upper shoulder protection, neck protectors or collars, and detachable groin protectors.

The police-type "vests", in particular, lack protection for the uppermost chest, the neck and the lower face, very vulnerable areas of the body. One approach to solving this problem is to provide a mantle-type removable piece which the user slips on over his head to lie on top of the armor vest across the shoulders and upper chest, and to provide a standup collar around the neck. However, in many situations requiring the protection of the armor, the user does not have time to find and put on such detachable supplemental protection, if indeed he happens to be carrying one on his person (unlikely due to the weight) or have one stored nearby in a vehicle or building. And, wearing such full upper chest and neck-protecting armor in the periods between threat situations is heavy, hot, restricts movement, eliminates the ability to conceal the fact that armor is being worn, and covers a significant portion of the underlying uniform or clothing.

SUMMARY OF THE INVENTION

The present invention solves the foregoing problems with an integral, easily deployed and yet concealable body armor extension which can be moved quickly into position to protect the neck and face of the user. In general, the extension comprises a panel of armor material, preferably at least semi-rigid, which can be raised or extended from a storage position on the vest to a protective position where it acts as an extension of the vest to cover the uppermost chest, neck and lower face regions.

In a preferred form, the extendable body armor panel is stored on the vest in a pouch of the type commonly used to layer extra panels of armor over the chest to increase the ballistic rating of the vest. Various mechanical means of deployment can be used, including but not limited to pivot arrangements, sliding mechanisms, and folding construction.

These and other aspects of the invention will become apparent upon further reading of the specification and attached drawings.

DETAILED DESCRIPTION OF THE DRAWINGS

Figure 1:
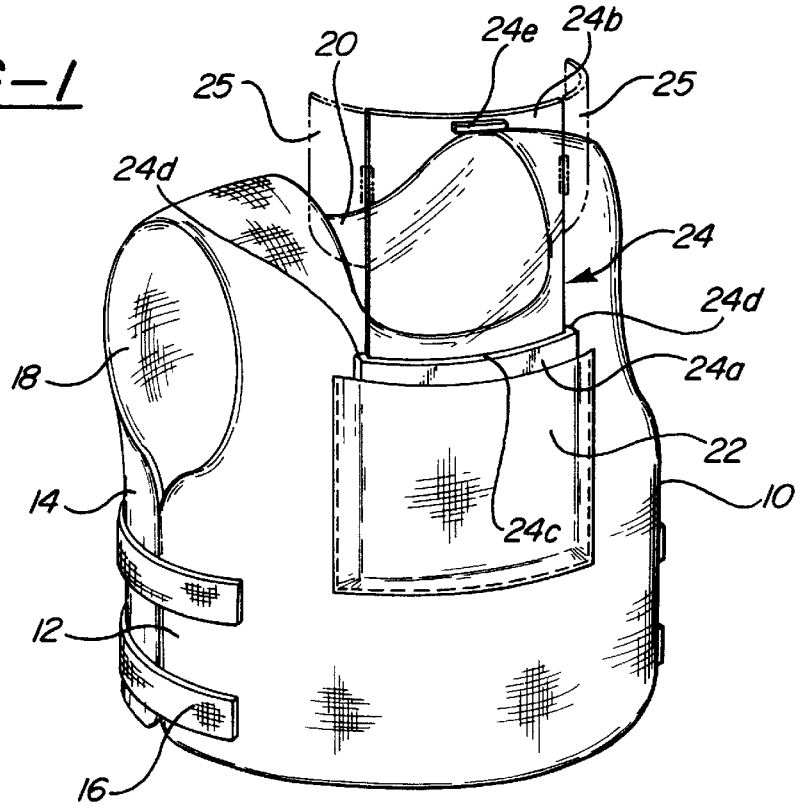
FIG. 1 is a front perspective view of a common style of concealable body armor vest, incorporating an easily-deployed extender panel according to the present invention.

Referring first to FIG. 1, a common style of concealable soft body armor vest 10 is shown incorporating the present invention. It will be apparent to those skilled in the art that the invention is also useful with virtually all known styles of body armor, whether the police-type vest illustrated or more extensive, non-concealable versions, although use with the police-style vest shown is a preferred embodiment.

Vest 10 comprises a front panel 12 which protects the vital organs from threats to the front of the body, and a matching rear panel 14 which protects the vital organs from threats to the back of the body, panels 12 and 14 being joined at the shoulder to drape over the head and shoulders of the wearer. Front and back panels 12 and 14 are secured about the sides of the wearer by ordinary hook and loop-type straps 16, such as Velcro® fastener. Vest 10 is tailored to provide large arm holes 18 and a well-ventilated low-cut neck opening 20 for freedom of movement, ventilation and concealment.

Body armor is commonly supplied with ballistic plate pouches 22, usually one on the front, and sometimes (especially in military vests) in the back. Pouch 22 may have different measurements, usually on the order of 6×8 inches or 10×12 inches, to accept an extra layer of soft armor, a hardened impact-reducing plate, or other user-protecting, bullet-resisting inserts. In the preferred embodiment of the present invention, a standard ballistic insert pouch 22 is used to house an extendable ballistic shield mechanism 24 as part of vest 10 so that it can be readily available and easily deployed in a moment's notice.

In the embodiment of FIG. 1, extendable ballistic shield mechanism 24 comprises a base plate or panel 24A which fits snugly in pouch 22, either in addition to (or more likely, in place of) the standard ballistic insert. To keep the pouch from becoming too bulky, it is preferable to make base 24A from a bullet-resistant material to take the place of the usual insert. Extendable shield mechanism 24 also includes at least one raised shield portion 24B, also formed from a bullet-resistant or ballistic material, preferably at least semi-rigid, and having a dimension of approximately the same size or smaller than pouch 22 so that it can be stored in a retracted storage position in pouch 22 when concealment and ventilation are primary considerations.

In FIG. 1, raised shield 24B is connected to base plate 24A in a sliding relationship, such that it can be easily pulled up out of pouch 22 by small handle portion 24E when the need for neck and face protection arises. Face shield 24B slides upwardly on base plate 24A until it reaches its upper limit shown in FIG. 1, whereupon whatever sliding mechanism is employed (slots or grooves, tracks, or other known structure) catches the lower edge of plate 24B to hold it in place. There is preferably some overlap between the lowermost edge of raised shield 24B (hidden behind or within base plate 24A in FIG. 1), and the upper edge of base plate 24A, both for ballistic protection and for rigidity of plates 24A, 24B as a unit 24.

In the illustrated embodiment of FIG. 1, a simple sliding arrangement is illustrated in which base plate 24A is formed with a contoured rear face 24C bordered by deeper edge portions 24D to form a wide channel or slot which accepts raised shield 24B in a snug, sliding fit. Shield 24B may be held in its raised position by sliding friction fit with 24C and 24D, by mating strips of hook and loop material formed respectively on the lower face of extended plate 24B and the rear upper edge of 24C; by pin or roller structure formed on the lower side edges of plate 24B mating with grooves or tracks in edges 24D of the base plate 24A, and releasable locking detent structure at the upper end of the slots in edges 24D; or any other known mechanism by which two panels can be slid relative to one another with a temporary locking connection at their extended position.

In FIG. 1, raised shield 24B is illustrated as being transparent for purposes of illustration, for example made from a bullet-resistant Lexan™ material, although it would be apparent to those skilled in the art that virtually any ballistic material can be used, for example steel, ceramics, suitably-stiffened soft body armor panels made from Kevlar™, Spectra™ and other known ballistic fabrics, and may be opaque.

It should be understood that the invention is not limited to a shield 24 having the specific shape illustrated in FIG. 1, i.e. a square or rectangle the dimensions of which roughly match that of pouch 22, although this is a preferred arrangement. Nor is the invention limited to a standard pouch 22, but may be used with pouches of different shapes, or locations on the vest 10, including storage pouches or locations contoured around the curved neck opening 20, in which case laterally interlocking panels of a softer, semi-rigid, ballistic material would be preferable to a rigid plate.

FIG. 1 also shows in phantom two curved side panels 25 hinged to main raised shield 24*b* for protecting the sides of the wearer's neck and lower head. Side panels 25 illustrate just one possible curved, collar-type arrangement for a deployable shield according to the present invention, which may be custom-dimensioned for various degrees of surrounding protection for the neck, head and face. It is also possible to form shield 24b and curved side panels 25 as a removable, non-extendable insert for pouch 22, wherein it would be carried nearby for insertion into the pouch when needed. However, the concealed, deployable shield illustrated above is preferred.

Figure 2:
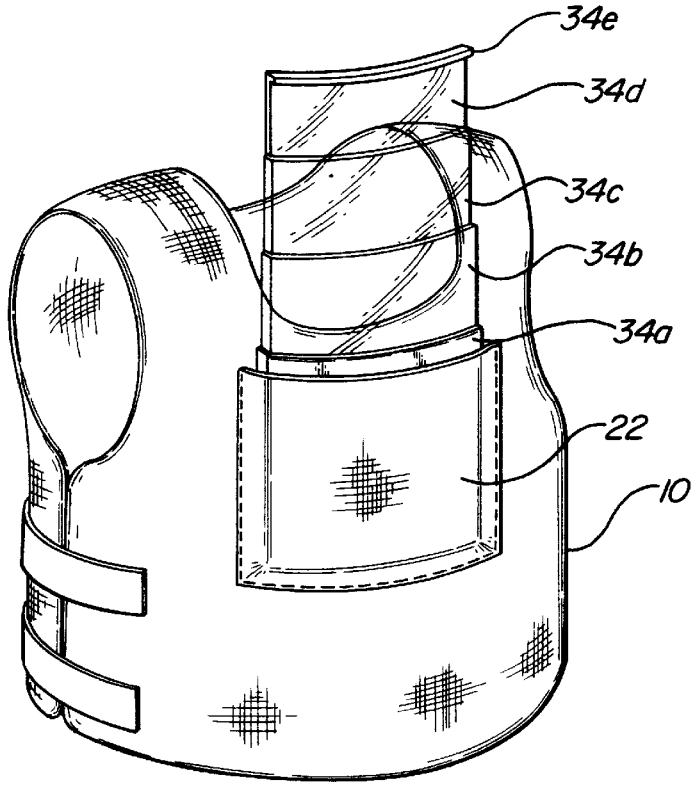
FIG. 2 is a perspective view of the vest of FIG. 1, with an alternate embodiment of the extender panel arrangement of FIG. 1.

Referring now to FIG. 2, an alternate embodiment of the shield arrangement in FIG. 1 is shown incorporated into vest 10, comprising multiple raised shield portions 34B, 34C and 34D telescoping and sliding fashion from base 34A in pouch 22. Again, shield portions 34B–D are shown as being transparent for ease of illustration, although other non-transparent ballistic materials can be used as described above. The sliding and locking mechanism between raised shields 34B–D can comprise any of the mechanisms described above for FIG. 1, or any combination thereof. The shields are raised by pulling on a finger grip surface or small handle 34E on the upper-most shield 34D until all shields have been fully extended and locked in place.

While not previously mentioned, base plates 24A, 34A described above in FIGS. 1 and 2 are preferably held securely in pouch 22 by some sort of attachment structure, for example, mating hook and loop strips between the vest 10 or pouch 22 and plates 24A, 34A. It is important to hold the base plate 24A, 34A securely in the pouch to withstand the lifting forces applied to the raised shield or shields when the extendable shield mechanism is being deployed.

As described above with reference to FIG. 1, the multiple raised shield portions 34B–D of FIG. 2 preferably have some overlap between them for ballistic protection and rigidity in the extended position.

Figures 3, 4:
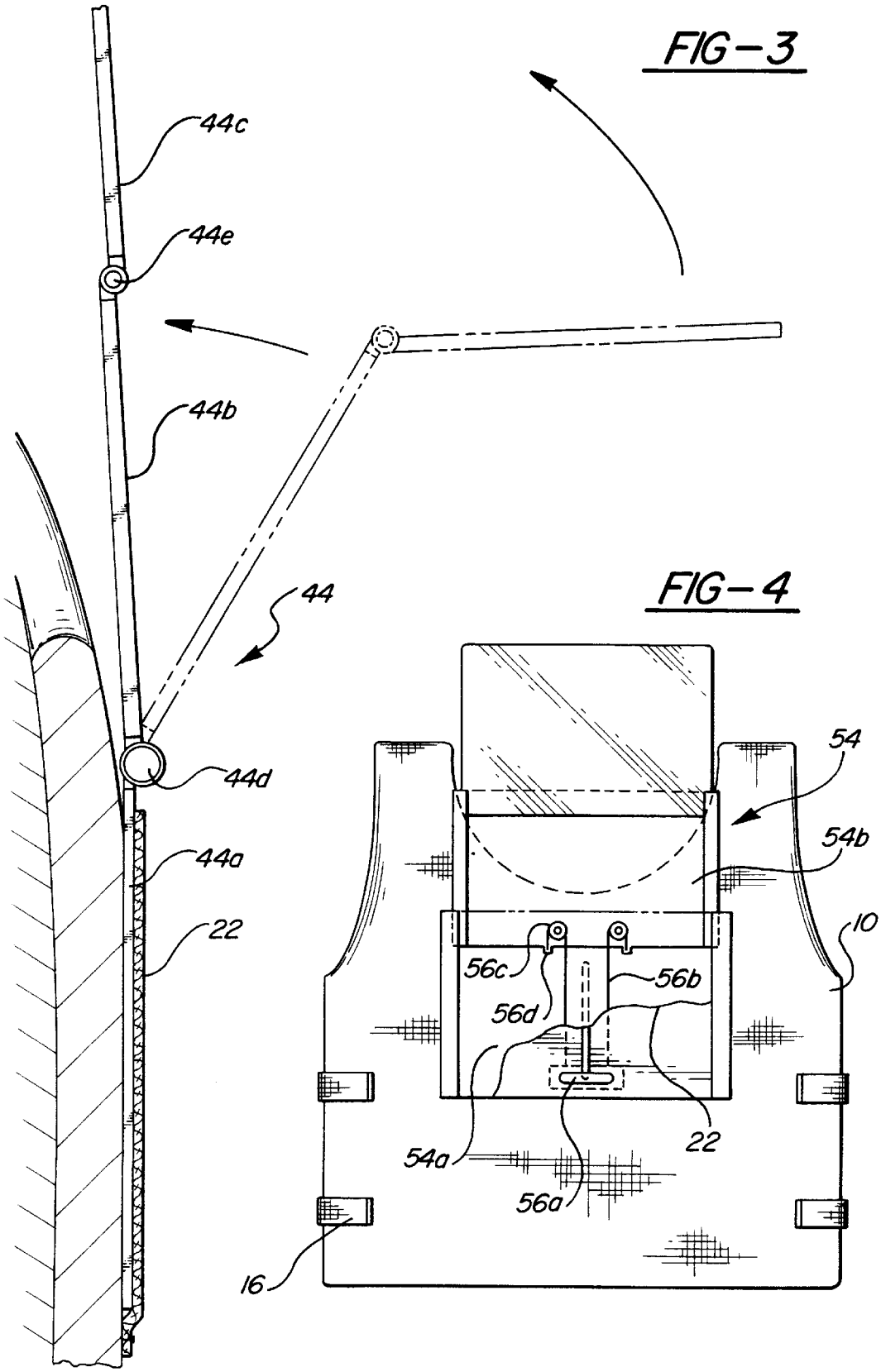
FIG. 3 is a side view of a pivoting mechanism for the extender panel.
FIG. 4 is a front view of a vest, partially in section, illustrating another alternate deployment mechanism comprising a pull handle or lanyard and one or more telescoping slide panels.

Referring now to FIG. 3, yet another alternate employment of raised shield portions is illustrated in a pivoting shield mechanism 44, with a base plate 44A held securely in pouch 22 on the front of vest 10, while raised shield portions 44B, 44C are connected to each other and to base plate 44A by pivot joints 44D, 44E. In the embodiment of FIG. 3, raised shield portions 44B, 44C may lie outside pouch 22 in the storage position, rotated down around pivot joint 44D to lie on the outside front surface of pouch 22. The embodiment in FIG. 3 is illustrated primarily to show the different types of known mechanical structures which can be used to deploy and interlock one or more raised shield portions to the base plate attached to the vest.

Referring next to FIG. 4, yet a further embodiment of the inventive extendable shield armor is shown generally at 54, comprising a base plate 54A held in pouch 22 in the front of the vest, sliding raised shield portions 54B, 54C interconnected with one another and base plate 54A, and a lanyard-type deployment mechanism 56 illustrated schematically with a pull handle 56A, a lanyard 56B, circular lanyard guides 56C, and a slide activator portion 56D connected to at least one of raised shield panels 54B, 54. Base plate 54A and raised shield portions 54B, 54C can be made from the same variety of materials described above in reference to FIGS. 1 and 2, with upper shield 54C being shown for being illustrated in exemplary fashion as being made from a clear ballistic material.

Raised shield panels 54B, 54C are raised by the user reaching pull handle of 56A and tugging downwardly such that lanyard 56B acting through guides 56C pull upwardly on a lower edge of raised shield 54B at attachment points 56D. In the illustration version it may be necessary to deploy upper-most shield portion 54C by hand once intermediate shield 54B has been raised through lanyard mechanism 56, although it is also possible to attach lanyard mechanism 56 to the upper-most shield 54C, if desired, depending on the desired deployment options.

It will be understood by those skilled in the art that the foregoing exemplary embodiments of my invention are not intended to limit my invention to the specific embodiments shown, but rather to provide enabling disclosure for those skilled in the art. Again, the exact shape of the extendable shield invention, its storage location on the vest and the specific deployment mechanism used can vary to accommodate different types of vests and desired neck/face protection levels, although the chest-pocket mounted, front panel protection embodiment illustrated in FIGS. 1–4 is a preferred embodiment. Accordingly,

I claim:

1. A neck and face protecting structure for supplementing the coverage of a ballistic vest, comprising:

an extendable neck/face protecting shield maintained within a pouch for mounting on the vest in a non-extended storage position for extending from the non-extended storage position to an extended neck/face protecting position in which the neck/face protecting shield remains mounted on the vest with a portion of the shield secured in the pouch.

2. The apparatus of claim 1, wherein the extendable neck/face protecting shield includes a base secured in the pouch, and the shield is extendable from a storage position adjacent the base on the vest upwardly to the neck/face protecting position, the shield remaining connected to the base secured in the pouch in the neck/face protecting position.

3. The apparatus of claim 2, wherein a major portion of the shield is stored in the pouch with the base in the storage position.

4. The apparatus of claim 3, wherein a shield is slidably connected to the base and is slidable from the storage position out of the pouch to the extended neck/face protecting position.

5. The apparatus of claim 4, wherein the shield comprises multiple slidably connected portions for extending from the storage position in the pouch to the neck/face protecting position in telescoping fashion.

6. The apparatus of claim 4, wherein the shield includes a gripping portion accessible from the exterior of the pouch when the shield is in the storage position.

7. The apparatus of claim 4, wherein the shield is contained entirely within the pouch in the storage position.

8. The apparatus of claim 1, wherein the extendable neck/face protecting shield includes a base secured to a front panel of the vest, and the shield is extendable from a storage position adjacent the base on the vest upwardly to the neck/face protecting position, the shield remaining connected to the base secured to the vest in the neck/face protecting position.

9. The apparatus of claim 8, wherein the shield is pivotally connected to the base.

10. The apparatus of claim 9, wherein the shield comprises multiple portions pivotably connected to the base and to each other.

11. The apparatus of claim 8, wherein the vest includes a lanyard type deployment mechanism having a pull handle mechanically connected to the shield and for raising the shield when pulled downwardly.

12. The apparatus of claim 1, wherein the shield comprises a main shield portion and deployable side panel portions connected to the main shield portion and deployable to the side of the main shield portion once the main shield portion has been extended to the neck/face protecting position.

13. A method for supplementing the ballistic coverage offered by a ballistic vest so as to protect the neck and face of the wearer beyond the neck/face protection offered by the ballistic vest, comprising the following steps:

securing an extendable neck/face protecting shield maintained within a pouch in a storage position on the vest, the storage position defining a non-extended position on a front portion of the vest in which the neck/face protecting shield is carried while the vest is worn under non-neck/face protecting circumstances, the shield being deployed from the storage position to a neck/face protecting position under circumstances recommending the supplement of neck/face protection, wherein the neck/face protecting shield remains attached to the vest with a portion of the shield secured in the pouch,

14. A neck and face protecting structure for supplementing the coverage of a ballistic vest, comprising:

an extendable neck/face protecting shield mounted on the vest and having a non-extended, concealed storage position on the vest in which the shield is below the neck/face of the wearer of the vest, and having an extended, non-concealed neck/face protecting position in which a portion of the neck/face protecting shield remains mounted on the vest while the shield protects the neck/face of the wearer of the vest.

* * * * *